US006186875B1

(12) United States Patent
Cook et al.

(10) Patent No.: US 6,186,875 B1
(45) Date of Patent: Feb. 13, 2001

(54) BOWLING BALL SURFACING MACHINE

(76) Inventors: Larry A. Cook, 5504 W. Alworth St., Suite A, Boise, ID (US) 83714; Gary Solomon, 560 Central Middleton Rd., Nampa, ID (US) 83651

( * ) Notice: Under 35 U.S.C. 154(b), the term of this patent shall be extended for 0 days.

(21) Appl. No.: 09/110,082

(22) Filed: Jul. 2, 1998

(51) Int. Cl.[7] ..... B24B 5/00
(52) U.S. Cl. ..... 451/268; 451/50
(58) Field of Search ..... 451/50, 268, 112, 451/262, 450, 548, 363, 486

(56) References Cited

U.S. PATENT DOCUMENTS

| | | | | |
|---|---|---|---|---|
| 0,828,894 | * | 8/1906 | Martin | 451/262 |
| 2,405,344 | | 8/1946 | Cloutier | 51/56 |
| 3,024,578 | | 3/1962 | Mushkin | 51/117 |
| 3,110,987 | * | 11/1963 | Arneson | 451/268 |
| 3,167,884 | | 2/1965 | Thompson | 51/3 |
| 3,609,918 | * | 10/1971 | Hillman | 451/268 |
| 3,961,448 | | 6/1976 | Akahane | 51/117 |
| 3,971,164 | | 7/1976 | Albin et al. | 51/129 |
| 5,299,394 | | 4/1994 | Surdacki | 51/289 S |
| 5,484,329 | | 1/1996 | Engelbrekston | 451/523 |
| 5,613,896 | | 3/1997 | Haus et al. | 451/50 |

FOREIGN PATENT DOCUMENTS

| | | | | |
|---|---|---|---|---|
| 3121759 | * | 5/1991 | (JP) | 451/50 |
| 4269157 | * | 9/1992 | (JP) | 451/50 |
| 1122484 | * | 11/1984 | (SU) | 451/50 |

OTHER PUBLICATIONS

Advertisement from Taxi Bowling Products.
Advertisement from Haus Specialty Manufacturing.
Grainger Catalogue, 1997, No. 388, p. 232 and 248.
Copy of Product Packaging—Rio 600 Aqua Pump/Power Head.

* cited by examiner

*Primary Examiner*—Robert A. Rose
(74) *Attorney, Agent, or Firm*—Ken J. Pedersen; Barbara S. Pedersen

(57) ABSTRACT

A machine for lapping bowling balls and, thus, re-rounding, smoothing, and cleaning the balls. The machine is comprised of three concave abrasion blocks with drive motors, adjustable mounting brackets attached to an adjustable support table, a catch basin with filter to separate suspended solids from liquids, and a pump and fluid delivery tube to deliver flushing and/or cleaning liquids. The abrasion blocks are comprised of resilient concave blocks with abrasive sanding disks. The positions of all three abrasion blocks are preferably simultaneously and equally adjusted by small adjustments to the position of a top table relative to the stand that holds the pivotal motor mounts. Ramps on the rotatable table cooperate with the mounts to slightly pivot the motor mounts inward and outward from the ball, changing the orientation and distance of the abrasive blocks relative to each other and, hence, to the ball. When a bowling ball (or other sphere) is received within, and supported by, the independently-turning cutting blocks, the asymmetrical "high" areas of the ball are frictionally moved and abraded by the sanding disks until such areas are removed and the ball is essentially perfectly spherical. Additionally, chips and dents and pollutants such as accumulated lane oil are removed or much reduced.

20 Claims, 4 Drawing Sheets

BOWLING BALL SURFACING MACHINE

BACKGROUND OF THE INVENTION

1. Field of the Invention.

The invention relates to the field of abrading solid, generally spherical objects, particularly bowling balls, to an essentially perfectly spherical shape. More specifically, such abrasion is affected by rotation of opposed concave abrasion blocks which receive and support said bowling ball. As the abrasive blocks are rotated by motors, the asymmetrical ball is frictionally moved and abraded by the sanding disks.

2. Related Art.

Bowling balls are invariably worn and damaged in the course of normal use and transport. In use, balls are first skidded upon their release until friction against the lane imparts a rolling motion. Finger holes drilled into the balls compel the ball to land and be abraded in the same location with a resultant flat spot which increases over time and use. Also with time and use, lane oil impregnates into, and accumulates upon, the ball and adversely effects its performance. In the course of travel and storage, other damage such as chips and dents typically occurs with attendant deterioration of ball performance. Thus, balls require resurfacing and rerounding from time to time to maintain good performance.

Related art of this category is embodied in machines comprised of three essential elements: (1) a plurality of concave sanding blocks; (2) a motor or motors to rotate the sanding blocks; and (3) support structure for the preceding elements. Additional or less typical components include mechanical adjustments, electrical controls, slurry systems, and pneumatic cleaning devices.

Regarding the first element, some form of concave sanding blocks is usual, but not universal, to the field of ball abrading devices. U.S. Pat. No. 2,405,344 to Cloutier discloses a configuration of six "bowl-shaped members" with a "flexible abrasive" surface. U.S. Pat. No. 3,024,578 to Mushkin discloses an opposed pair of grinding heads, each with "a cup-like cylindrical shell" and a replaceable "abrasive conical interior element". A "Sphere Lapping Machine and Method" described in U.S. Pat. No. 3,167,884 to Thompson discloses lapping by "a plurality of hollow laps". U.S. Pat. No. 3,961,448 to Akahane discloses three concave "polishing dishes or lopping cups". U.S. Pat. No. 5,613,896 to Haus et al. discloses three "cone-shaped abrading cups", each having an "annular abrading area". Not abrading by way of concave sanding blocks is the "Bowling Ball Resurfacing Machine" described in U.S. Pat. No. 3,971,164 to Albin et al. which, instead, "rotates a sanding disc".

Regarding motors for rotating the concave abrasion blocks, various configuration are disclosed in the related art. Cloutier discloses a single motor connected by a belt to an elliptical gear which imparts "reciprocation and rotation" to the bottom one of the six "bowl-shaped members". Similarly, Mushkin and Thompson each drive only one shaft and concave abrasion block, imparting all motion to the ball through that single propulsion. Haus, in the reference of which Applicant is aware that is most like the subject invention, discloses a separate drive motor for each of those three abrasion cups.

Regarding support structures of related art, each of the inventions referenced here is configured to accommodate its particular method and components. Of some relevance to the subject invention are the flushing systems set forth in certain references. Mushkin discloses pneumatic nozzles for moving swarf out of the abrasion areas. Thompson discloses a motor-agitated slurry basin which causes "slurry to be splashed upwardly against the under surface of the sphere". Haus discloses a "funnel shaped container" for dripping a limited amount of "lubricating liquid such as water".

SUMMARY OF THE INVENTION

The present invention is a machine for lapping bowling balls and, thus, rerounding, smoothing, and cleaning the balls. The machine is comprised of three concave abrasion blocks and drive motors, hinged mounting brackets attached to an adjustable support table, a catch basin with filter to separate suspended solids from liquids, and a pump and fluid delivery tube to deliver flushing and/or cleaning liquids. The abrasion blocks are comprised of resilient concave blocks with abrasive sanding disks. When a bowling ball (or other sphere) is received within, and supported by, the independently-turning abrasion blocks, the asymmetrical "high" areas of the ball are frictionally moved and abraded by the sanding disks until such areas are removed and the ball is essentially perfectly spherical. Additionally, chips and dents and pollutants such as accumulated lane oil are removed or much reduced.

The advantages of the subject invention over related art include: (1) a much improved design and configuration of the motor mount brackets (and, therefore, the motors and abrasion blocks) and means for their adjustment; (2) an effective flushing and/or slurry system with means for delivery to the ball and abrasion blocks and for collection and recirculation; and (3) an integrated support structure to accommodate the aforementioned improvements. As a result, essentially perfect roundness is achieved faster because the improved flushing system removes cuttings and keeps the abrasive sanding disks clean. It also keeps swarf from becoming airborne and conducts particles to a sump for filtration and removal. The method for receiving and holding the ball is improved and maintains the ball in productive motion without the oversight of an attendant. These advantages translate directly to savings of time and labor. Also, the improved motor mount adjustment (opening and closing) mechanism and flushing/slurry system allow unattended or minimally-attended operation of the machine.

As will be later presented in greater detail, an integrated, two-part support structure is the structural basis for securing and adjusting the motor mounts (and, hence, the motors, contour abrasion blocks, and bowling ball). This innovative structure is comprised of an under part(, the basin, an over part, the table, and both basin and table are pivotally connected at or near their central axes and preferably further attached by a screw-crank means for adjustment of their relative position. The motor mounts are pivotally attached to the basin; the mounts are slidably supported by respective ramps made part of the table. By moving the crank, the basin and table are made to move relative to each other with resultant adjustment of the motor mounts. This method has been shown to provide sure positioning, that is, sure opening and closing, of the components, both during the surfacing process and for sphere loading and unloading from the machine.

The basin and table structure also accommodates the enhanced flushing and slurry system. The basin accumulates fluids to a sump in which are contained a pump for recirculation and may or may not contain a filter. Collection is facilitated by broad motor mount brackets which tend to catch the fluids and direct them to the basin. The brackets also protect the motors. Spokes of the table further accommodate fluid collection. The capacity to deliver a relative large volume, as well as a variety of fluids and slurry, is an important innovation.

The machine may be used for different surfacing/polishing applications, such as lapidary work. Different spheres, such as different balls or gemstones, may be accommodated by adjustment of the motor mounts and/or by use of variously-sized cutting heads/abrasion blocks and motor shafts lengths. Larger, heavier spheres may require scaling up of the size of the invented machine, and addition of heavy duty gear motors of varying torque and rpm.

DESCRIPTION OF THE PREFERRED EMBODIMENTS

Figure 1:
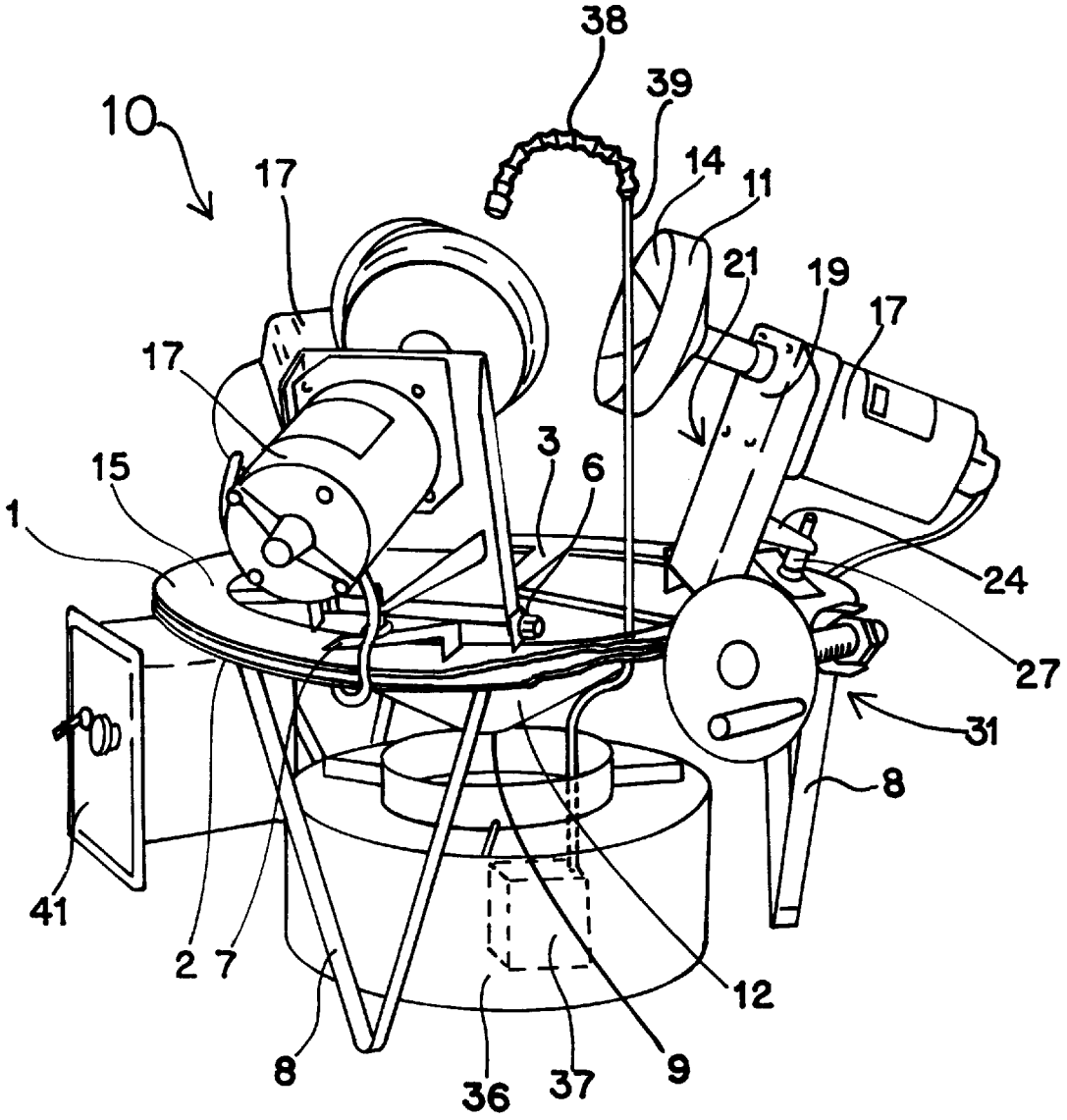
FIG. 1 is an overall perspective of one embodiment of the invented bowling ball rerounding and resurfacing machine.
Figure 2:
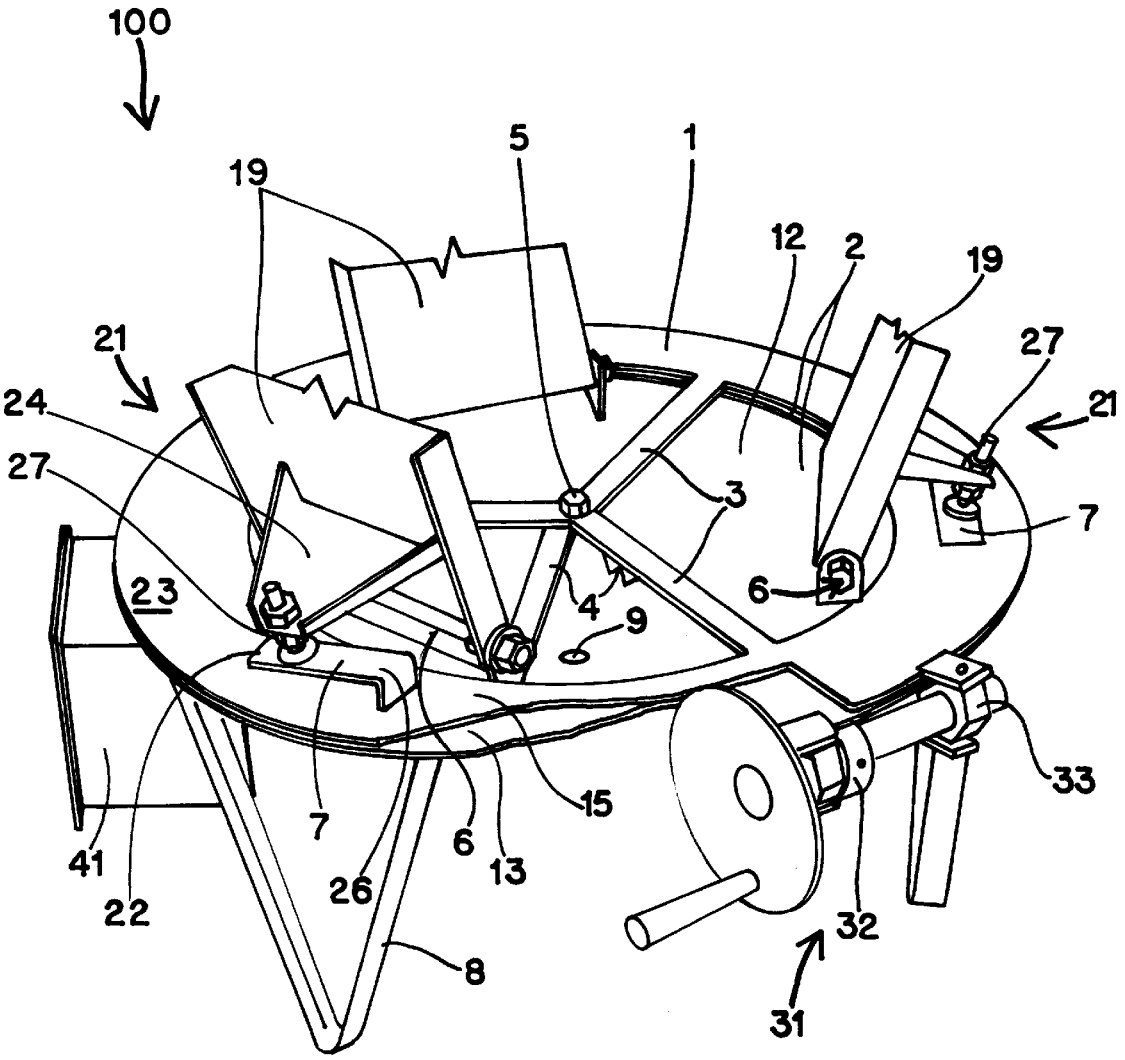
FIG. 2 is a perspective view of the embodiment of FIG. 1, shown without the sump, motors, and fluid drip systems.
Figure 3:
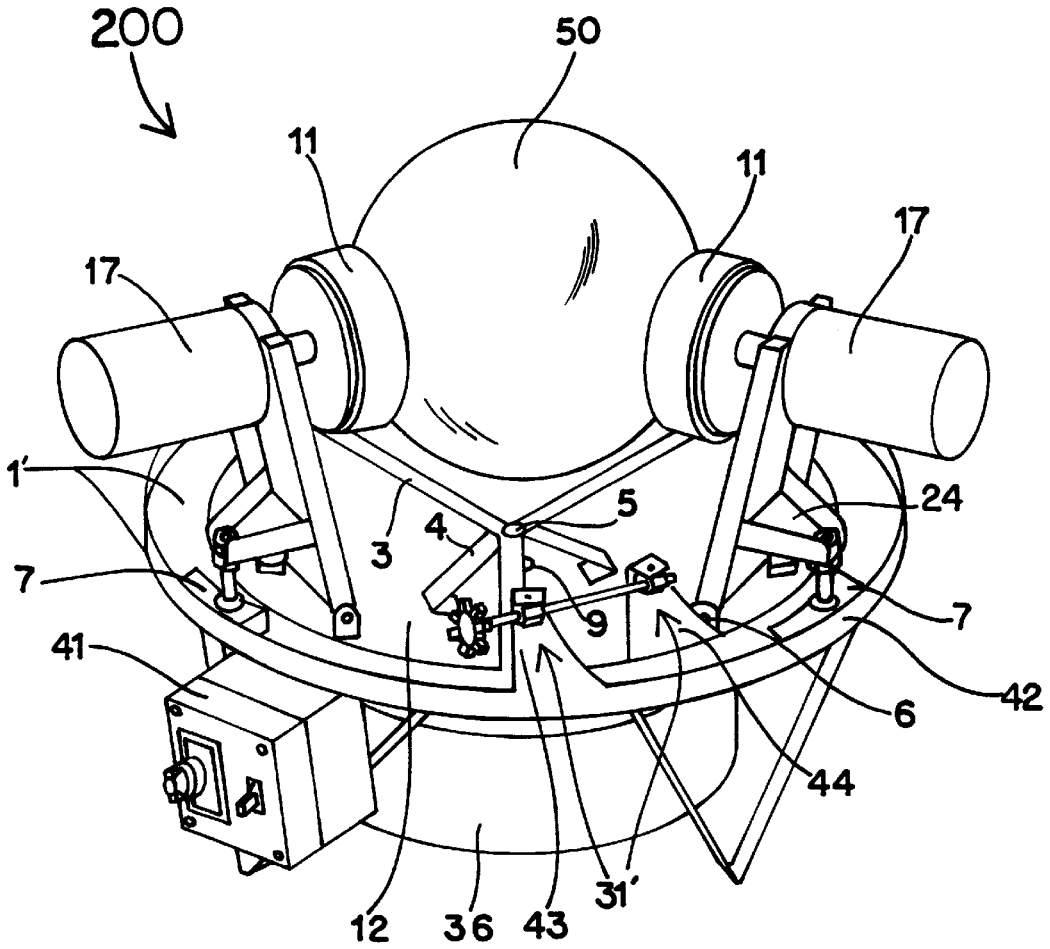
FIG. 3 is a perspective view of another embodiment of the invented machine polishing a bowling ball.
Figure 4:
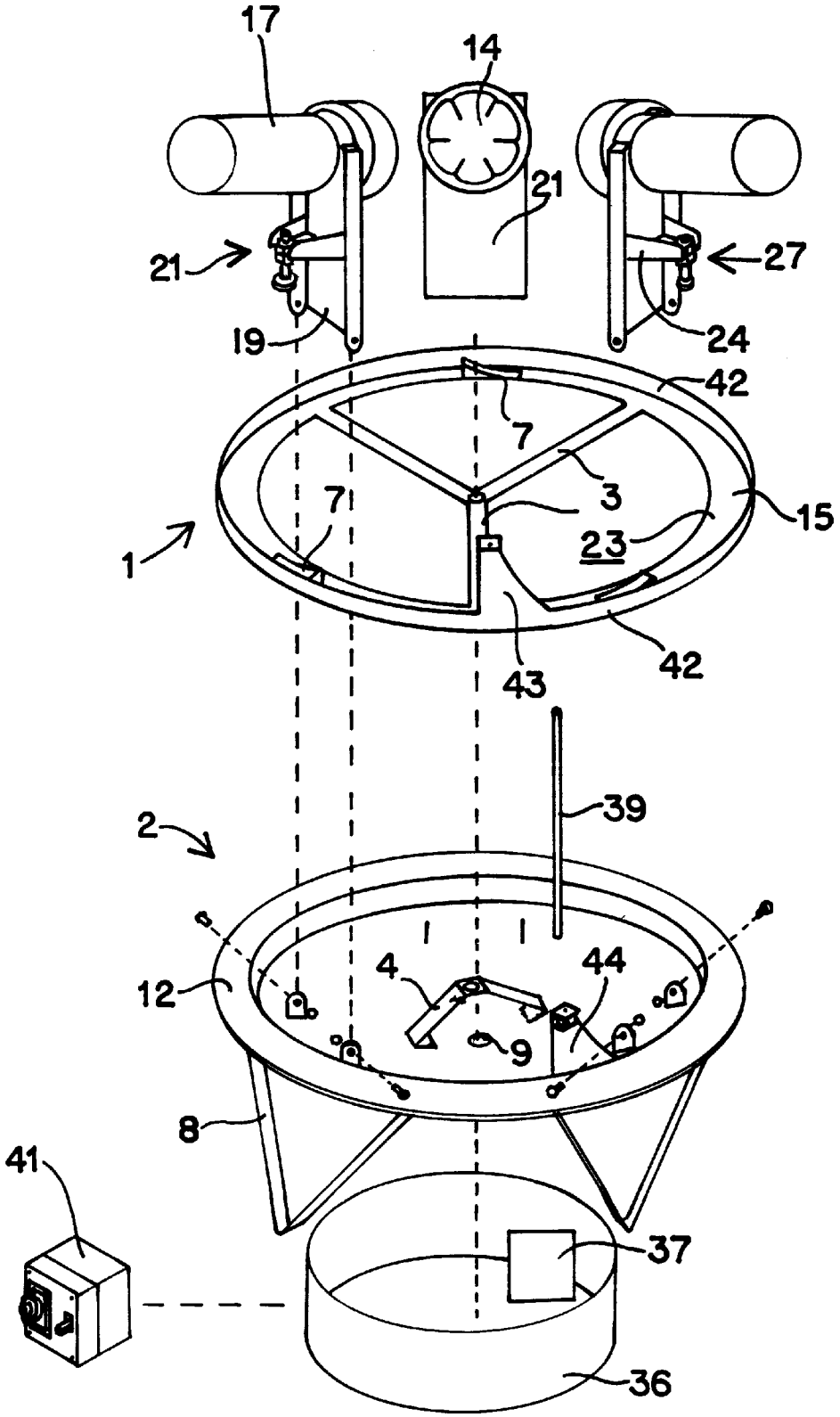
FIG. 4 is an exploded view of the embodiment of FIG. 3, without the screw-crank system.

Referring to FIGS. 1 and 2, there is presented one, preferred embodiment of the bowling ball rerounding and resurfacing machine 100. FIGS. 3 and 4 present an alternative embodiment of the machine 200 and an exploded view of its basic elements.

The machine 100 comprises a liquid-catching stand, motors with polishing disks, and a table which rotates relative to the stand to adjust the positions of the motors and polishing disks. Basin 2 is supported by legs 8 and in turn supports table 1. Basin 2 has a central bowl 12, with a drain hole 9 for catching fluids and particulate that fall down off the ball, and a generally flat horizontal rim 13 surrounding the bowl. Table 1 also has a generally circular, plate-like outer rim 15 which substantially lies in a horizontal plane parallel to the basin rim. The table lies upon the basin, held in place by way of a plurality of spokes 3 extending radially inward from the table rim 15, which rotatably connect to the basin at the basin central axis by way of basin bracket 4 (a V-shaped bracket extending up from the bowl 12) and axle bolt 5. Thus, table and basin are connected to be generally coaxial, and so that the table may turn about its axis such that its rim 11 rotates parallel to the basin rim 12, which does not move. Basin and table are further connected by screw-crank means for adjustment, comprising threaded nuts 32 and 33, or equivalents, attached to basin and table, respectively, threaded "screw" 34, and crank 31. The screw-crank system is preferred because it allows small and accurate incremental adjustments, however, other adjustable connectors may be used to adjust the relative position of the basin and table rims 13, 15.

Referring now to FIGS. 1 and 2, three motor mounts 21 are each pivotally attached to the basin by pivot brackets 6, in the bowl 12, so that the mounts 21 extend up through the center opening of the table. Each motor mount includes an arm 19, tilt bracket 24 and an adjustable stop 27. The tilt bracket 24 is rigidly attached behind the arm 19 at right angle, with adjustable stop 27 attached to the tilt bracket 24. The adjustable stop 27 screws in and out perpendicularly to the tilt bracket 24, moving the end of the stop toward and away from the bracket 24, respectively.

Corresponding to each such stop and rigidly attached to the table are three tilt ramps 7. By cranking the adjustment means 31–34, the table and basin are caused to move in relatively opposite direction and, depending on the direction of relative movement, stops 27 slide sideways on tilt ramps 7 to move up or down tilt ramps 7, thus causing motor mounts to tilt into, or away from, the center of the machine. Adjustment of the surfacing units (abrasive block, motor, and motor mount) may be fine-tuned, for example, for different ball sizes, by screwing the three adjustable stops 27 in or out from the tilt brackets 24.

Each of the three ramps are preferably identical in shape, size, and orientation relative to the rim, and are 120 degrees apart to cooperate with the surfacing units, which are also 120 degrees apart. The ramps are preferably about 2–3 inches long. Two portions of the ramp are at different distances from the rim, that is, the first end 22 of each ramp is preferably close to or flush with the rim upper surface 23, and the second end 26 is preferably about ½–1 inch above the rim upper surface 23. Alternative ramp dimensions may be used to obtain the desired sensitivity of adjustment, or other protrusion shapes besides a ramp may be used to contact and bias the surfacing units into desired positions.

An electric control box 28 houses motor and pump controls and other electrical components such as capacitors, if needed.

Attached to each motor mount 21 is a motor 17 for rotating its attached concave abrasion block 13. The concave area of the abrasion block is fabricated of resilient material and upon this area is attached a flexible and replaceable sanding disk 14 for abrading the bowling ball 50. The preferred motor is a Dayton fractional AC gear motor, ¼ horsepower, available from W.W. Grainger, Inc., Chicago, Ill., stock no. 4Z065. The preferred concave abrasion block is the "CAB" with replaceable sanding disks available from Taxi Bowling Products, Walnut Creek, Calif.

The flushing and/or slurry system is comprised of the sump tank 36 located beneath, and preferably attached to, the basin 2. Within the sump tank 36 is a pump 37 such as a Rio 600 Aqua Pump/Power Head or equivalent available at aquarium supply stores. By way of a delivery tube 39 with gooseneck 38, water or other desired fluid or slurry is pumped onto the bowling ball and into the concave abrasion surfaces. As the fluid or slurry falls or spins off the rotating ball, it is recovered by the basin 2 and drained into the sump tank 36 through drain hole 9. A filter (not shown) for separating swarf from fluid to be recirculated may be desirable.

The machine is operated by closing the concave abrasion blocks 13 upon the bowling ball (or other sphere) by turning the screw-crank 31. The motor mounts 21 are arranged to position the concave abrasion blocks 13 to close upon the bowling ball at approximately 20° to 30° from vertical and, in that way, position the concave abrasion blocks to receive and support the ball vertically without undue horizontal pressure. Thus positioned, the rerounding and resurfacing operation may be begun by turning on the pump and motors.

As the independently driven concave abrasion blocks 13 turn, the motion of each is frictionally imparted to the ball by the sanding disks 14 which contact, but do not seize, the ball.

The ball, dragged by various contacts moving in continually changing directions, moves randomly through the sanding disks. The sanding disks abrade the asymmetrical "high" areas of the ball until such areas are removed and the ball is essentially perfectly spherical. Additionally, chips and dents and pollutants such as accumulated lane oil are removed or much reduced.

This process is significantly enhanced by effectively flushing swarf from the abrasion areas and facilitating the exposure of a clean ball to fresh sanding disks. One skilled in the art can reasonably foresee advantage in employment of various fluids. For example, addition of detergent has been shown to accelerate removal of lane oil. A fine polish or delicate resurfacing could be achieved by removing the sanding disks and moving the ball through the resilient concave blocks in a slurry of rouge suspended in water or other fluid.

FIGS. 3 and 4 show an alternative design of a machine 200, with alternative designs of table 1' and adjustor 31'. The table 1' includes a liquid-containing lip 42 to help prevent drips and splashes. The table 1' and basin 2 each have an upwardly-protruding tab 43, 44 which are connected by adjustor 31' which can shorten or lengthen the distance between the tabs 43, 44 to slide the table counterclockwise or clockwise, respectively (as viewed in FIGS. 3 and 4). As in the embodiment of FIGS. 1 and 2, this rotation serves to pivot the motor mounts and, hence, the relationship of the polishing disks to the ball.

Alternatively, other configurations may be used to accurately and controllably adjust the angle of the abrasion blocks to the bowling ball or other sphere. Other designs of support structure may be used, wherein a first and a second member are connected and the first member rotates relative to the second member to selectively place a protrusion in contact with a motor mount for biasing the motor mount. For example, the first member may be a lower member with the second member on top of it. The motor mounts may be connected to the top member and a protruding member may reach from the lower member to contact, upon rotation of the lower member, the motor mounts, for biasing them toward or away from the ball.

Although this invention has been described above with reference to particular means, materials and embodiments, it is to be understood that the invention is not limited to these disclosed particulars, but extends instead to all equivalents within the scope of the following claims.

We claim:

1. A sphere surfacing machine comprising:

a support structure having a central axis and comprising a first member and a second member;

a plurality of surfacing units, each surfacing unit comprising an abrasion block, and each surfacing unit pivotally connected to the support structure second member so that each surfacing unit pivots in a plane parallel to and passing through the central axis;

wherein the first member is generally coaxial with the second member and rotates on its axis relative to the second member, the first member having a protrusion contacting one of said surfacing units and biasing the surfacing unit to pivot inward toward the structure central axis for adjusting the position of the abrasion block for surfacing a sphere.

2. A machine as in claim 1, comprising three surfacing units arranged around the central axis wherein the machine comprises three protrusions, each of said protrusions contacting a different one of said surfacing units to bias the surfacing units to pivot inward.

3. A sphere surfacing machine comprising:

a support structure having a central axis and comprising a first member and a second member; and a plurality of surfacing units mounted to the support structure second member, each comprising an abrasion block;

wherein the first member is generally coaxial with the second member and rotates on its axis relative to the second member, the first member comprising a protrusion contacting one of said surfacing units and biasing the surface unit toward the structure central axis for adjusting the position of the abrasion block of the surfacing unit for surfacing a sphere; wherein the first member is a top member having an axis, a central opening, a rim around the central opening, and at least one spoke extending from the rim to the axis, wherein the second member is a bottom member and the surfacing units are connected to the bottom member and extend up through the central opening.

4. A machine as in claim 3, wherein the top member has an upward protrusion that contacts the surfacing unit upon rotating of the top member relative to the bottom member to bias the surfacing unit toward the central axis.

5. A machine as in claim 3, comprising an adjustor connecting the first member and the second member, wherein the adjustor is adapted to incrementally rotate the first member relative to the second member.

6. A sphere surfacing machine comprising:

a support structure having a central axis and comprising a first member and a second member; and a plurality of surfacing units mounted to the support structure second member, each comprising an abrasion block;

wherein the first member is generally coaxial with the second member and rotates on its axis relative to the second member, the first member comprising a protrusion contacting one of said surfacing units and biasing the surface unit toward the structure central axis for adjusting the position of the abrasion block of the surfacing unit for surfacing a sphere;

wherein the sphere surfacing machine further comprises an adjustor connecting the first member and the second member, wherein the adjustor is adapted to incrementally rotate the first member relative to the second member, and wherein the adjustor comprises bolts connected to each of the first member and the second member and a threaded member received in the bolts and adapted to be turned to rotate the first member relative to the second member.

7. A sphere surfacing machine comprising:

a stand;

a plurality of surfacing units pivotally connected to the stand for receiving a sphere between the surfacing units, each surfacing unit comprising an abrasion block for surfacing the sphere, a motor connected to and powering the abrasion block, and a mount for connecting the motor and abrasion block to the stand;

a generally horizontal table having an axis and rotatably connected at its axis to the stand and adapted to rotate in a generally horizontal plane relative to the stand, the table comprising at least one upward protrusion contacting at least one of the resurfacing units, wherein rotation of the table moves the protrusion relative to the resurfacing unit to pivot the resurfacing unit toward and away from the table axis.

8. A machine as in claim 7, comprising three surfacing units arranged at 120° from each other.

9. A machine as in claim 7, wherein the machine further comprises a sump system connected to the stand and located below the table for collecting liquid falling from the sphere.

10. A machine as in claim 7, wherein the stand comprises a bowl below the table for catching liquid falling from the sphere, and wherein the table comprises a central opening, a rim having an upper surface surrounding the opening, and spokes extending from the rim to the table axis and connected to the bowl.

11. A machine as in claim 10, wherein the protrusion comprises a ramp extending up from the rim upper surface, the ramp having a slanted top surface having a first end and a second end, wherein the second end is further from the rim upper surface than is the first end, the slanted upper surface slidably contacting the surfacing unit so that the second end forces the surfacing unit away from the rim upper surface and so that the first end allows the surfacing unit closer to the rim upper surface.

12. A machine as in claim 7, comprising an adjustor connecting the stand and the table, wherein the adjustor is adapted to incrementally rotate the table relative to the stand.

13. A machine as in claim 12, wherein the adjustor comprises bolts connected to the stand and the table and a threaded member received in the bolts and adapted to be turned to rotate the table relative to the stand.

14. A sphere surfacing machine comprising:

a stand having a basin for catching liquid falling from the sphere and legs supporting the basin, the basin having a bowl, a generally horizontal rim surrounding the bowl, and a central axis;

a plurality of surfacing units pivotally connected to the stand for receiving a sphere between the surfacing units, each surfacing unit comprising an abrasion block for surfacing the sphere, a power source operatively connected to the abrasion block, and a mount for connecting the power source and abrasion block to the stand, wherein each surfacing unit is pivotal toward and away from the cental axis of the basin;

a table located above the basin and rotatably connected at its axis to the basin, the table having a central opening and a generally horizontal table rim around the central opening, parallel to the basin rim, and adapted to rotate in its generally horizontal plane relative to the basin rim, the table rim comprising a plurality of upward protrusions, each upward protrusion slidably contacting one of the resurfacing units, wherein rotation of the table slides each protrusion relative to its surfacing unit to pivot the surfacing unit toward and away from the basin central axis.

15. A machine as in claim 14, comprising three surfacing units arranged at 120 degrees from each other and extending up through the table opening to receive the sphere.

16. A machine as in claim 14, wherein the bowl has a drain hole, and the machine further comprises a sump system connected to the stand and located below the bowl for collecting the liquid.

17. A machine as in claim 14, wherein the table comprises spokes extending from the rim to the central axis and connected to the bowl.

18. A machine as in claim 17, wherein the table rim has an upper surface, the surfacing units extend up through the table central opening to receive the sphere, and each protrusion comprises a ramp extending up from the rim, the ramp having a slanted top surface having a first end and a second end, wherein the second end is located further from the rim upper surface than is the first end, wherein the ramp slanted upper surface slidably contacts the surfacing unit, wherein the second end forces the surfacing unit away from the rim to be nearer the basin central axis, and wherein the first end allows the surfacing unit closer to the rim upper surface to be further from the central axis.

19. A machine as in claim 14, comprising an adjustor connecting the basin and the table, wherein the adjustor is adapted to incrementally rotate the table relative to the basin.

20. A machine as in claim 19, wherein the adjustor comprises bolts connected to basin rim and the table rim and a threaded member received in the bolts and adapted to be turned to rotate the table relative to the stand.

* * * * *